United States Patent [19]

Kikuta

[11] Patent Number: 4,592,612

[45] Date of Patent: Jun. 3, 1986

[54] ELECTRIC CONNECTOR HAVING COVER CASE

[75] Inventor: Sigeru Kikuta, Tokyo, Japan

[73] Assignee: Hirose Electric Co., Ltd., Tokyo, Japan

[21] Appl. No.: 608,103

[22] Filed: May 8, 1984

[30] Foreign Application Priority Data

Jan. 23, 1984 [JP] Japan ..... 59-7490[U]

[51] Int. Cl.[4] ..... H01R 13/46

[52] U.S. Cl. ..... 339/143 R

[58] Field of Search ..... 339/143 R, 138, 141

[56] References Cited

U.S. PATENT DOCUMENTS

| | | | |
|---|---|---|---|
| 3,659,251 | 4/1972 | Fish | 339/143 R |
| 3,977,755 | 8/1976 | Edel et al. | 339/143 R |
| 4,009,923 | 3/1977 | Aistleither | 339/143 R |
| 4,215,236 | 7/1980 | Reiser | 339/141 |
| 4,272,148 | 6/1981 | Knack, Jr. | 339/143 R |
| 4,449,778 | 5/1984 | Lane | 339/143 R |
| 4,453,798 | 6/1984 | Asick et al. | 339/143 R |
| 4,457,576 | 7/1984 | Cosmos et al. | 339/143 R |
| 4,508,414 | 4/1985 | Kusui et al. | 339/143 R |

FOREIGN PATENT DOCUMENTS 57-203483 12/1982 Japan .

*Primary Examiner*—Gil Weidenfeld
*Assistant Examiner*—Gary F. Paumen
*Attorney, Agent, or Firm*—Fleit, Jacobson, Cohn & Price

[57] ABSTRACT

An electric connector comprises a nonconductive connector body having contacts arranged therein and adapted to be coupled to a mating conductive connector shell, a nonconductive cover case having at one end thereof an opening for receiving a shielded cable, onto the other end of which cover case the nonconductive connector body can be put, and a conductive shielding case and a shielded cable clamp member which can be disposed in the cover case. The shielded cable clamp member can be made electrical contact with the shielding wire of the shielded cable and then placed in a clamp member receiving cavity formed near the opening of the cover case. One end of the conductive shielding case is adapted to make contact with the shielded cable clamp member placed in the clamp member receiving cavity, and the other end of the conductive shielding case is shaped so as to enclose the nonconductive connector body put onto the cover case. At least one shield contact tongue hole is formed in the portion of the nonconductive connector body to which the mating conductive connector shell is to be coupled. The conductive shielding case is provided at the other end thereof with at least one resilient shield contact tongue which can be inserted into the shield contact tongue hole of the nonconductive connector body and can make contact with the mating conductive connector shell being coupled to the nonconductive connector body.

1 Claim, 2 Drawing Figures

ELECTRIC CONNECTOR HAVING COVER CASE

BACKGROUND OF THE INVENTION

1. Field of the Invention

This invention relates to an electric connector having a cover case, and more particularly to a multi-contact electric connector having a nonconductive cover case.

2. Description of the Prior Art

In electric connectors of this type, various countermeasures have been taken for suppressing external noise in the parts connected with shielded cables. It has been considered to apply shielding to the part therefor, and an example of this measure is as disclosed in the official gazette of Japanese Utility Model Registration Application Laying-open No. 57-203483. In this prior art, an electric connector which is attached to a shielded cable and which has a nonconductive cover case is so constructed that conductive plates defining substantially the same shape as that of the recess of the nonconductive cover case are installed along the inner wall of the aforementioned recess, so as to hold the shielding braid of the cable and a conductive connector shell in electrical connection. According to such construction of the prior-art electric connector, the external noise can be suppressed to some extent owing to a shielding effect based on the conductive plates. With the construction, however, the shield is not satisfactory because it is performed only by one pair of parallel conductive plates. Moreover, the electrical connection of the shielding part with the mating conductive connector shell is performed in the order of the shielding braid of the shielded cable-the conductive plates—the conductive connector shell—a mating conductive connector shell, and a large number of electrical connection points are involved. It has accordingly been difficult to attain a stable shielding connection and to suppress the influence of the external noise stably without a dispersion among the articles of the electric connector.

An object of this invention is to solve the problems of the prior art electric connector as described above, and to provide an electric connector having a cover case which can suppress noise stably.

SUMMARY OF THE INVENTION

According to this invention, there is provided an electric connector comprising a nonconductive connector body having contacts arranged therein and adapted to be coupled to a mating conductive connector shell, a nonconductive cover case having at one end thereof an opening for receiving a shielded cable, onto the other end of which cover case the nonconductive connector body can be put, and a conductive shielding case and a shielded cable clamp member which can be disposed in the cover case, the shielded cable clamp member being able to make electrical contact with the shielding sheath of the shielded cable and then placed in a clamp member receiving cavity formed near the opening of the cover case, one end of the conductive shielding case being adapted to make contact with the shielded cable clamp member placed in the clamp member receiving cavity, the other end of the conductive shielding case being shaped so as to enclose the nonconductive connector body put onto the cover case, at least one shield contact tongue hold being formed in the portion of the nonconductive connector body to which the mating conductive connection shell is to be coupled, the conductive shielding case being provided at the other end thereof with at least one resilient shield contact tongue which can be inserted into the shield contact tongue hole of the nonconductive connector body and can make contact with the mating conductive connector shell being coupled to the nonconductive connector body.

This invention will now be described in further detail with regard to a preferred embodiment as illustrated in the accompanying drawings.

DESCRIPTION OF THE PREFERRED EMBODIMENTS

Figure 1:
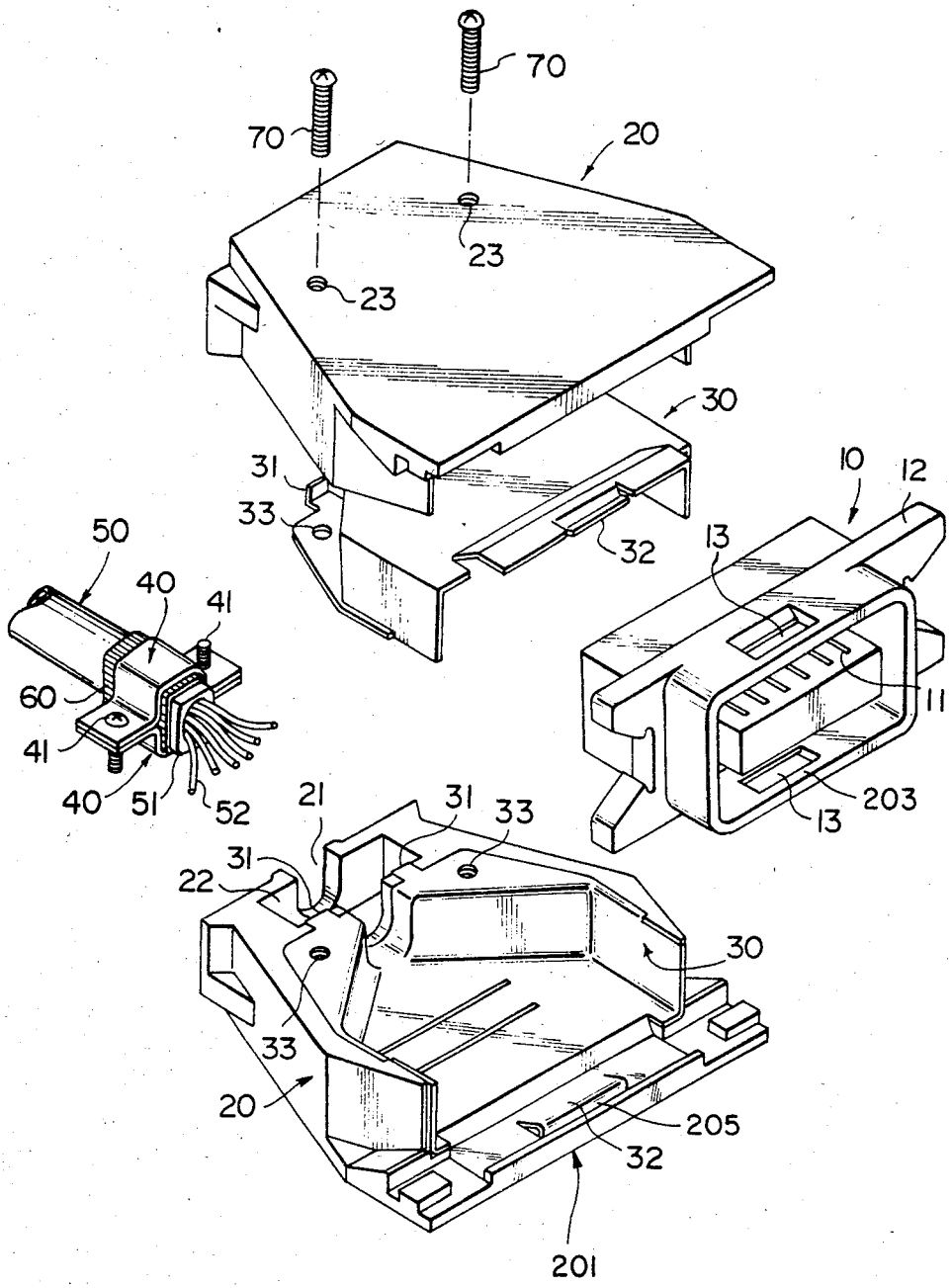
FIG. 1 is an exploded perspective view of an embodiment of the electric connector according to this invention.

Referring now to FIG. 1, there is shown an electric connector according to an embodiment of this invention. The electric connector of this embodiment principally comprises a plug connector unit 10, a pair of plug cases 20, a pair of shielding cases 30 and a pair of cable clamp fixtures 40.

The plug connector unit 10 is made of a nonconductive connector body 12 formed of, e.g., an insulating material such as synthetic resin which is provided with plug contacts 11 and which can fit on a mating conductive connector shell. The pair of plug cases 20 are formed of, e.g., an insulating material such as synthetic resin. When combined with each other, they construct a nonconductive cover case which has at one end thereof an opening 21 for receiving a shielded cable 50 and which can install the nonconductive connector body 12 at the other end thereof by gripping the sides of connector body 12 with gripping piece 201. The pair of shielding cases 30 are formed of a resilient conductive metal material, and when combined with each other, they construct a conductive shielding case which is disposed in the cover case. The pair of cable clamp fixtures 40 are formed of a conductive metal material, and they construct a shielded cable clamp member when combined with each other.

The cable clamp fixtures 40 can be combined and held with each other by the use of clamp screws 41 so as to clamp the shielded cable 50 through a conductive tape 60 which is wound round the shielding sheath 51 of the shielded cable 50, the shielding sheath 51 being folded back on the outer periphery of the shielded cable by exposing the conductors thereof. In such clamping state, the cable clamp fixtures 40 are arranged in a clamp member receiving cavities 22 adjacent the openings 21 within the plug cases 20.

On the other hand, each of the shielding cases 30 has at one end thereof a pair of clamp fixture contact lugs 31 which come into contact with the front end face of the combined cable clamp fixtures 40 arranged in the clamp member receiving cavity 22, while the other end of the shielding case 30 is so shaped as to surround the nonconductive connector body 12 which is mounted in the plug case 20. As shown in the lower part of FIG. 1, each shielding case 30 is disposed within a recess which is provided in the corresponding plug case 20.

That, part of the nonconductive connector body 12, which is fitted in the mating conductive connector shell 30, is formed with shield contact tongue holes 13. A portion of tongue hole 13 is defined by front inner wall 203. The other end of each shielding case 30 is formed with a resilient shield contact tongue 32 which is inserted into the shield contact tongue hole 13 of the nonconductive connector body 12 and thus can lie in contact with the mating conductive connector shell fitted in the body 12. The front end 205 of tongue 32 is partially covered and protected by front inner wall 203 when the connector is assembled but a portion of the tongue still extends through hole 13 to enable contact with the mating conductive connector shell (see FIG. 2).

Further, the plug cases 20 and the shielding cases 30 are respectively provided with threaded holes 23 and 33 for passing clamp screws 70 in corresponding positions.

A method of assembling the electric connector of such construction and a method of connecting the shielded cable will be briefly explained below.

First, as illustrated in the left part of FIG. 1, the end part of the shielding cable 50 to be connected is dealt with and is clamped by the clamp fixtures 40 as described before. On the other hand, the front ends of the cable conductors 52 exposed separately are respectively connected to the rear ends of the corresponding plug contacts 11 which are disposed in the nonconductive connector body 12 of the plug connector unit 10. Subsequently, as illustrated in the lower part of FIG. 1, one shielding case 30 is disposed in the recess of the corresponding plug case 20. The clamp fixtures 40 clamping the shielded cable 50 are pushed into the clamp member receiving cavity 22 of the plug case 20 under such state. On this occasion, the front end face of the clamp fixtures 40 is brought into pressed contact with the clamp fixture contact lugs 31 of the shielding case 30 located along the front inner wall of the clamp member receiving cavity 22. In addition, the plug connector unit 10 connected to the cable conductors 52 is installed in the front end of the shielding case 30. On this occasion, the shield contact tongue 32 of the shielding case 30 is inserted into the shield contact tongue hole 13 of the nonconductive connector body 12. Next, relative to the plug case 20 and shielding case 30 under such arranged state, the combined state of the other shielding case 30 and plug case 20 similarly combined is held by passing the clamp screws 70 through the threaded holes 23 and 33.

Figure 2:
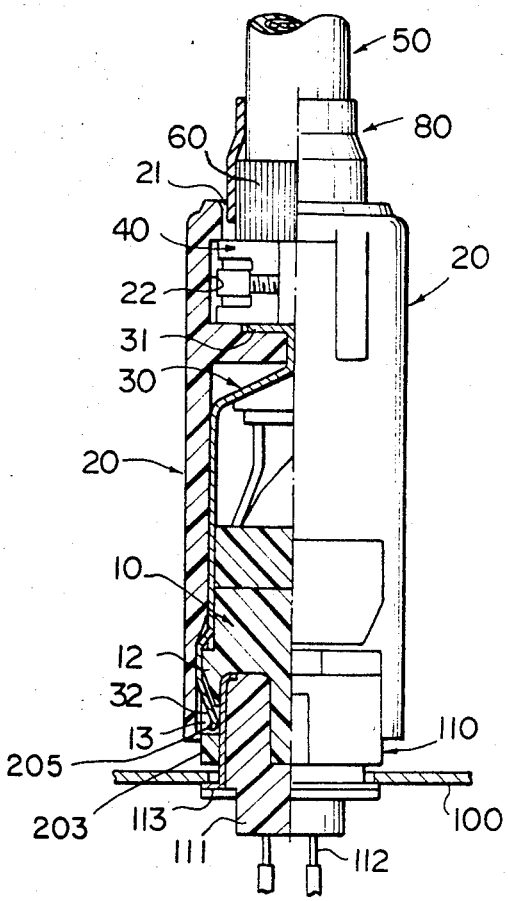
FIG. 2 is a half sectional view showing the electric connector of FIG. 1 as coupled to a mating connector.

FIG. 2 shows as a half sectional view the state in which the electric connector thus assembled and connected is fitted on a mating receptable connector 110 attached to a mounting panel 100.

The receptacle connector 110 is made of a nonconductive connector body 111 which is provided with receptacle contactors 112 and which is formed with a conductive connector shell 113 on its outer periphery. In FIG. 2, reference numeral 80 indicates a cable bushing.

Under the state shown in FIG. 2 under which the electric connector is fitted on the receptacle connector 110 behind the mating connector, the shielding sheath 51 of the shielded cable 50 is electrically connected to the conductive connector shell 113 of the receptacle connector 110 through the conductive tape 60, the clamp fixtures 40, the clamp fixture contact lugs 31 of the shielding cases 30, the bodies of the shielding cases 30 and the shield contact pieces 32 of the shielding cases 30.

Since the electric connector of this invention is constructed as stated before, the part of the shielded cable connected with the connector contacts is completely surrounded with the conductive shielding case, and besides, the shielding sheath of the shielded cable is electrically connected directly to the conductive shell of the mating connector by the conductive shielding case. Therefore, the number of contacts is small, and noise can be suppressed very stably. Moreover, since the shield is in direct contact with the clamp fixtures in the electric connector of this invention, a favorable contact can be attained irrespective of the diameter of the shielded cable, and the noise can be more suppressed. Further, owing to the construction in which the shielding cases are easily assembled inside the plug cases, when any measure against the noise is not necessary, the number of components can be reduced by readily detaching the shielding cases, so that an inexpensive connector can be provided.

I claim:

1. An electric connector comprising:

a nonconductive connector body having:

contacts arranged therein;

a coupling portion adapted to be coupled to a mating conductive connector shell; and, a rear end portion accommodating the wire connecting parts of said contacts;

a pair of cover case halves forming a nonconductive cover case when coupled to each other;

a pair of shielding case halves forming a conductive shielding case when coupled to each other and when coupled to a shield cable clamp member;

said coupling portion of said nonconductive connector body being provided in at least one side wall of the coupling portion with a shield contact tongue hole through the side wall;

each of said cover case halves having a gripping piece at the front end thereof, said gripping pieces of said cover case halves being adapted to grip both sides of said nonconductive connector body to hold said nonconductive connector in place in such a manner that at least said shield contact tongue hole can be covered by the gripping pieces when said cover case halves are coupled to each other;

each of said cover case halves having a first recess and a second recess, said first recess having an open end adjacent to said gripping piece, said open ends of said first recesses being adapted to form an opening for receiving a rear end portion of said nonconductive connector body when said cover case halves are coupled to each other, said second recess being adapted to form a clamp member receiving cavity for accommodating said sheilded cable clamp member when said cover case halves are coupled to each other, the rear end of said first recess communicating with the front end of said second recess through a passage adapted to receive said shielded cable, the rear end wall of said second recess having a notch formed therein, the notches of said cover case halves being adapted to form an opening for receiving said shielded cable when said cover case halves are coupled to each other;

each of said shielding case halves being adapted to be disposed within said first recess of said corresponding cover case halves so as to extend over substantially all of the inner wall surfaces of said first recess except said open end and said passage;

at least one of said shielding case halves being provided at the front end thereof with a resilient shield contact tongue, said shield contact tongue to extend along and between said gripping piece of said corresponding cover case half and said side wall of said coupling portion of said nonconductive connector body held therein, said shield contact tongue having an inwardly convexed contact point to enter into said shield contact tongue hole and protrude slightly and inwardly beyond the inner surface of said side wall of said coupling portion so as to make contact with said mating conductive connector shell when coupled to said coupling portion of said nonconductive connector body, the front end of said shield contact tongue being adapted to be covered by the front inner wall of said shield contact tongue hole in the coupling direction of said mating conductive connector shell;

said shielded cable clamp member being adapted to make electrical contact with the shielding wire of said shielded cable and then be placed in said clamp member receiving cavity;

said shield case halves being provided at the rear end thereof with at least one clamp member contact lug which can be located along the front inner wall of said second recess, the front end face of said clamp member adapted to be brought into pressed contact with said clamp member contact lug located along the front inner wall of said clamp member receiving cavity when said clamp member is pressed into said clamp member receiving cavity.

* * * * *